US011330904B2

(12) United States Patent
Khaliq

(10) Patent No.: US 11,330,904 B2
(45) Date of Patent: May 17, 2022

(54) APPARATUS FOR IMPROVING SUPPORT STRENGTH OF PLANAR SURFACES

(71) Applicant: Arthur Khaliq, Livermore, CA (US)

(72) Inventor: Arthur Khaliq, Livermore, CA (US)

( * ) Notice: Subject to any disclaimer, the term of this patent is extended or adjusted under 35 U.S.C. 154(b) by 0 days.

(21) Appl. No.: 15/847,888

(22) Filed: Dec. 19, 2017

(65) Prior Publication Data

US 2018/0168350 A1 Jun. 21, 2018

Related U.S. Application Data

(60) Provisional application No. 62/436,412, filed on Dec. 19, 2016.

(51) Int. Cl.
*A47B 96/07* (2006.01)
*A47B 57/48* (2006.01)

(52) U.S. Cl.
CPC ..... *A47B 96/07* (2013.01); *A47B 57/48* (2013.01)

(58) Field of Classification Search
CPC ..... A47B 57/00; A47B 57/26; A47B 96/07; A47B 57/48
USPC ..... 108/193, 147.11, 147.16; 248/200.1, 248/217.3, 218.3; 211/90.02
See application file for complete search history.

(56) References Cited

U.S. PATENT DOCUMENTS 457,977 A * 8/1891 Wilkening ..... A47K 10/04 211/123
1,381,607 A * 6/1921 Weston ..... A47F 5/0018 108/59
1,429,211 A * 9/1922 Lightburn ..... E21F 17/18 248/200.1
1,548,053 A * 8/1925 Mead ..... A47H 1/022 248/200.1
1,768,206 A * 6/1930 Lemons ..... B60J 1/14 135/123
1,793,036 A * 2/1931 Whitney ..... A47B 57/26 211/123
1,809,401 A * 6/1931 Cattell ..... E04F 21/26 248/200.1
1,982,957 A * 12/1934 Knell ..... H02G 3/126 180/68.5
2,140,861 A * 12/1938 Steketee ..... H02G 3/126 174/63
2,316,389 A * 4/1943 Atkinson ..... H02G 3/126 174/63
3,518,421 A * 6/1970 Cogdill ..... F21V 21/02 211/105.3
3,771,466 A * 11/1973 Ferdinand ..... A47B 57/42 108/109
4,659,051 A * 4/1987 Propp ..... E04B 9/006 248/200.1
4,717,099 A * 1/1988 Hubbard ..... A62C 37/10 248/228.1
4,737,056 A * 4/1988 Hunt ..... B60P 7/15 224/404
4,909,405 A * 3/1990 Kerr, Jr. ..... H02G 3/125 220/3.2
4,972,339 A * 11/1990 Gabrius ..... F21V 21/04 248/343

(Continued)

*Primary Examiner* — Kimberly T Wood
(74) *Attorney, Agent, or Firm* — Jubin Dana; Dana Legal Services

(57) ABSTRACT

In accordance with various embodiments of the invention, a support assembly or apparatus is disclosed that strengthens the planar load support of planar surfaces supported at the ends.

6 Claims, 10 Drawing Sheets

(56) References Cited

U.S. PATENT DOCUMENTS 5,024,412 A * 6/1991 Hung ..... H02G 3/20 220/3.9
5,042,766 A * 8/1991 Baker ..... F16M 13/025 248/200.1
5,150,868 A * 9/1992 Kaden ..... H02G 3/126 248/200.1
5,303,894 A * 4/1994 Deschamps ..... H02G 3/125 248/343
5,346,036 A * 9/1994 Arisman ..... A62B 35/04 182/3
5,505,419 A * 4/1996 Gabrius ..... F21V 21/04 248/200.1
5,720,461 A * 2/1998 Kerr, Jr. ..... E04B 9/006 248/217.3
5,845,886 A * 12/1998 McCormick ..... F04D 25/088 248/200.1
5,954,304 A * 9/1999 Jorgensen ..... H02G 3/125 248/200.1
6,237,884 B1 * 5/2001 Howe ..... F04D 25/088 248/200.1
6,461,016 B1 * 10/2002 Jamison ..... F21S 8/02 362/147
6,591,574 B2 * 7/2003 Humphrey ..... E04G 13/00 248/200.1
6,889,943 B2 * 5/2005 Dinh ..... B60N 2/073 248/343
7,381,893 B2 * 6/2008 Kerr, Jr. ..... H02G 3/125 174/50
7,621,493 B2 * 11/2009 Vermette ..... B60R 9/10 224/500
7,673,841 B2 * 3/2010 Wronski ..... F21V 21/048 248/200.1
8,261,509 B2 * 9/2012 Harkin ..... E04G 23/0237 52/645
9,004,421 B2 * 4/2015 Feenstra ..... A62C 35/68 248/200.1
9,889,327 B2 * 2/2018 Mitchell ..... A62C 35/68
2004/0262247 A1 * 12/2004 Moon ..... A47F 3/002 211/74
2006/0237601 A1 * 10/2006 Rinderer ..... H02G 3/125 248/200.1
2007/0012847 A1 * 1/2007 Tai ..... E04B 9/006 248/343
2008/0179481 A1 * 7/2008 Rubin de la Borbolla ..... H02G 3/125 248/343
2015/0060616 A1 * 3/2015 Jaramillo ..... A47B 81/061 248/200.1
2016/0126711 A1 * 5/2016 Colangelo ..... F16B 2/22 220/3.3
2016/0209007 A1 * 7/2016 Belmonte ..... F21V 21/047

* cited by examiner

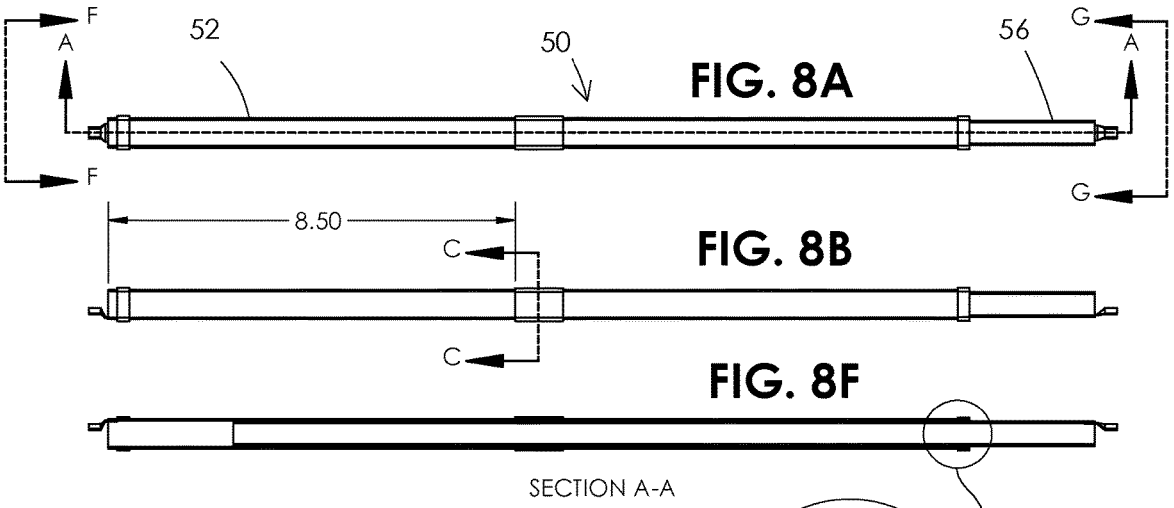
FIG. 8A
FIG. 8B
FIG. 8F
SECTION A-A
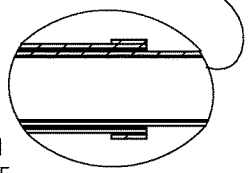
FIG. 8G
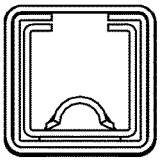
VIEW F-F
FIG. 8C
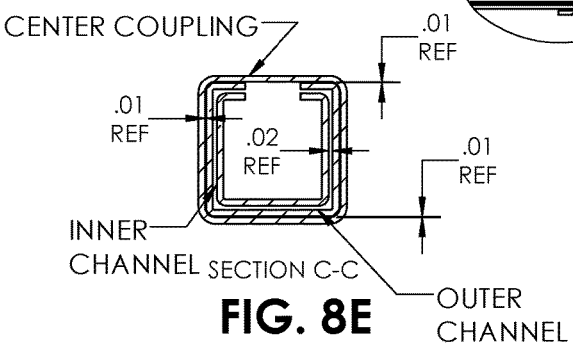
SECTION C-C
FIG. 8E
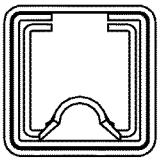
VIEW G-G
FIG. 8D
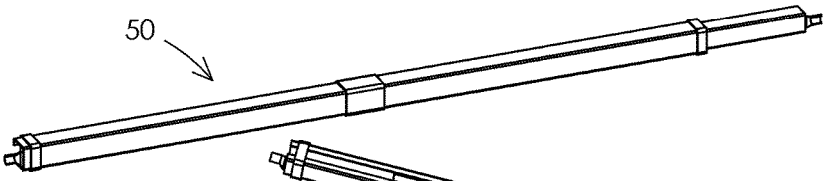
FIG. 6
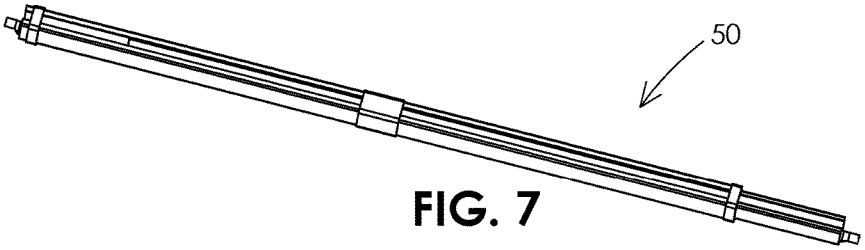
FIG. 7

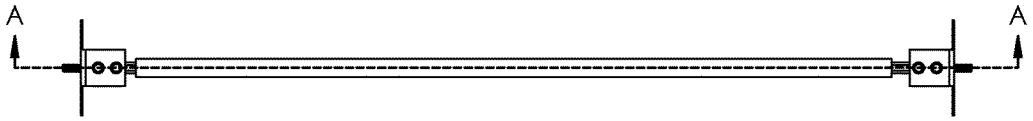
FIG. 9B
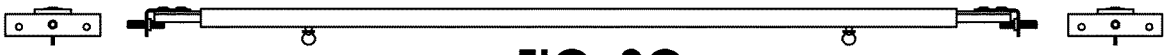
FIG. 9C
Fig. 9D
Fig. 9E
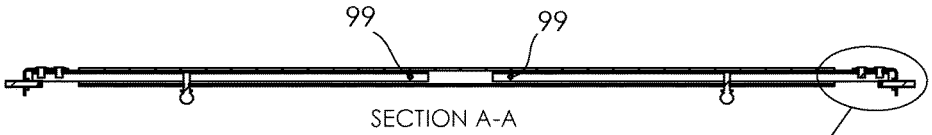
FIG. 9F
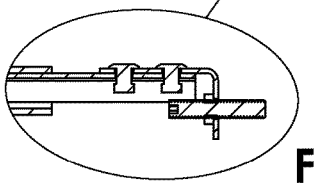
Fig. 9G
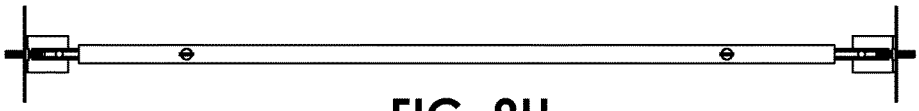
FIG. 9H

APPARATUS FOR IMPROVING SUPPORT STRENGTH OF PLANAR SURFACES

CROSS REFERENCE TO RELATED APPLICATION

This application claims the benefit of U.S. Provisional Application Ser. No. 62/436,412 filed on Dec. 19, 2016 with title APPARATUS FOR IMPROVING THE SUPPORT STRENGTH OF PLANAR SHELF by Art KHALIQ, the entire disclosure of which is incorporated herein by reference.

FIELD OF THE INVENTION

The invention is related to supports, and more particularly, to supports for load bearing planar surfaces.

BACKGROUND

There has been a need for an improved support system for planar surfaces, such as shelves or counters, that are load bearing. Whether they are in cabinets or mounted on brackets, they often will end up bowing, breaking, and potentially stripping or damaging the particle board or whatever material is used to make it. Many standard cabinets and book shelves, have a pin/peg, as shown in FIG. 1. This is the system that has become the norm for cabinets with non-permanent shelf placement. FIG. 1 shows the way many shelves are assembled today. Using a peg-type system to support shelves. Holes are commonly predrilled on the vertical support or side panels, to allow for adjustment up or down. FIG. 1 shows some of the vary many sizes the shelfs support pegs come in. The pegs range in size, material, construction and so forth.

The pegs provide the ability to move or customize the shelf placement, based on preset holes. The option to place the support anywhere can be accomplished as well, if no preset holes are present or preferred. The problem is, people do not have or often are not provided with weight limitations for the shelf. Sometimes, the shelves weaken due to humidity or moisture in the air. Often, over time, more and more things get stacked onto the shelves, which in turn, start bowing or bending the shelves closer to the center as there is no support for any section of the shelf, other than the corner or points, usually 4, where the shelf is supported by a pin/peg pushed into or attached to a vertical support or the side wall of the cabinet.

Over time, the wood (or material that the shelf is made from), weakens and slowly pulls the end of the shelfs out or away from the hole/socket, which the peg goes in, or pulls the supporting peg out of the sidewall it is mounted in. The shelf falls, pegs often get lost or break, or even worse, the wood strips and you are forced to relocate a bent shelf. Once the wood has reached a certain curve, it will fall or collapse from the original support system sooner and faster than when it was originally designed.

Once the shelf or shelves began to weaken or bow, it often affects the complete structure and structural strength of the original product. Whether it is a bookshelf or a garage cabinet, or whatever global purpose the shelf is used for, the side walls, doors (if the cabinet has them), top and other components of the main structure also become weakened.

A similar problem occurs when dealing with any planar surface that is supported near the extreme or ends. Therefore, what is needed is an apparatus that strengthens the planar load support of planar surfaces supported at the ends, such as shelves.

SUMMARY

In accordance with various embodiments of the invention, a support assembly or apparatus is disclosed that strengthens the planar load support of planar surfaces supported at the ends. The apparatus has many valuable features. It improves the strength of the planar support for planar surfaces, such as shelves or any planar surface that it can be applied to. There is no limit to construction material or style for this assembly. The invention also allows to lock and screw the support assembly in place so that the entire product can become stronger and more stable, often improving the ability to withstand vibrating environments or earthquakes.

BRIEF DESCRIPTION OF THE DRAWINGS

The invention is described in accordance with the aspects and embodiments in the following description with reference to the FIGURES (FIG), in which like numbers represent the same or similar elements.

FIG. 6 shows as a perspective view of an assembly in accordance with various embodiments of the invention.

FIG. 7 shows another perspective view of the assembly of FIG. 6.

FIG. 8A shows a top view of the assembly of FIG. 6 in accordance with various embodiments of the invention.

FIG. 8B shows a side view of the assembly of FIG. 6 in accordance with various embodiments of the invention.

FIG. 8C shows a left end view of the assembly of FIG. 6 in accordance with various embodiments of the invention.

FIG. 8D shows a right end view of the assembly of FIG. 6 in accordance with various embodiments of the invention.

FIG. 8E shows a cross-section end view along the line C-C of FIG. 8B in accordance with various embodiments of the invention.

FIG. 8F shows a cross-section side view along the line A-A of FIG. 8A in accordance with various embodiments of the invention.

FIG. 8G shows an enlarged view of section B in FIG. 8F in accordance with various embodiments of the invention.

FIG. 9B shows a top view of the support assembly of FIG. 9A in accordance with various embodiments of the invention.

FIG. 9C shows a side view of the support assembly of FIG. 9A in accordance with various embodiments of the invention.

FIG. 9D shows one end view of the support assembly of FIG. 9A in accordance with various embodiments of the invention.

FIG. 9E shows one end view of the support assembly of FIG. 9A in accordance with various embodiments of the invention.

FIG. 9F shows a cross-section view along the line A-A of the support assembly of FIG. 9B in accordance with various embodiments of the invention.

FIG. 9G shows an enlarged cross-section view of one end of the support assembly of FIG. 9F in accordance with various embodiments of the invention.

FIG. 9H shows a bottom view of the support assembly of FIG. 9A in accordance with various embodiments of the invention.

DETAILED DESCRIPTION

To the extent that the terms "including", "includes", "having", "has", "with", or variants thereof are used in either the detailed description and the claims, such terms are intended to be inclusive in a similar manner to the term "comprising". Reference throughout this specification to "one embodiment," "an embodiment," or similar language means that a particular feature, structure, or characteristic described in connection with the various aspects and embodiments are included in at least one embodiment of the invention. Thus, appearances of the phrases "in one embodiment," "in an embodiment," "in certain embodiments," and similar language throughout this specification refer to the various aspects and embodiments of the invention. It is noted that, as used in this description, the singular forms "a," "an" and "the" include plural referents, unless the context clearly dictates otherwise.

The described features, structures, or characteristics of the invention may be combined in any suitable manner in accordance with the aspects and one or more embodiments of the invention. In the following description, numerous specific details are recited to provide an understanding of various embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring the aspects of the invention.

Figure 1:
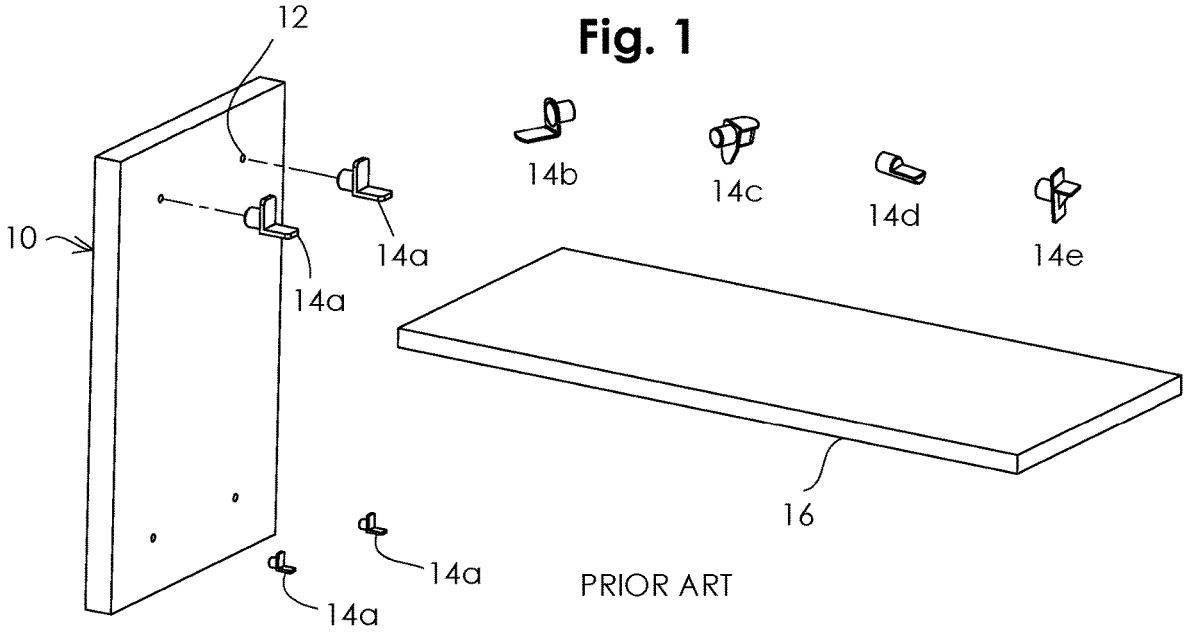
FIG. 1 shows some peg-like embodiments for supporting a shelf.

Referring now to FIG. 1, a vertical support 10 of shelf assembly is shown having a plurality of peg holes 12 therein. The peg holes are designed to, each, receive a peg 14. The pegs 14 can be of a variety of shapes, such as peg 14*a*, 14*b*, 14*c*, 14*d*, and 14*e*. When the peg 14 is positioned in the hole 12 of the vertical support 10, then the vertical support 10 along with a second vertical support (not shown) and four pegs, such as peg 14, collectively support a planar surface 16, such as a shelf. In one embodiment, a pair of vertical supports along with some planar surfaces, in the form of shelves, form a bookcase.

Figure 2:
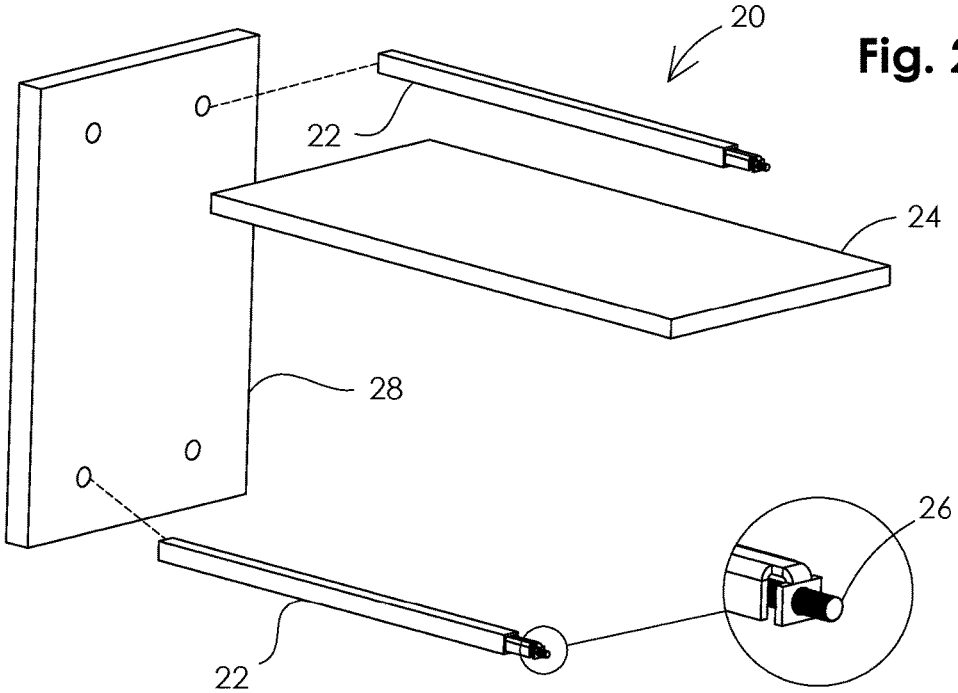
FIG. 2 shows a planar surface support assembly or system in accordance with various embodiments of the invention.

Referring now to FIG. 2, a new and improved support system 20 is shown in accordance with various embodiments of the invention. The system 20 includes a telescopic or telescoping support assembly 22 that supports along the entire length of a planar surface 24, such as the shelf. Examples of different type of planar surface where the assembly 22 can be used or implemented, include, but are not limited to, any hard surface that is horizontal and capable of bearing a load and need reinforcement for performance or safety reasons, such as: a granite table; a wood table; a granite shelf or counter; a couch or a bowing couch; steel shelf reinforcement; fence reinforcement or support; a sagging wooden floor support; a creaking wooden floor that needs reinforcement; a shelf support; earthquake proofing or safety improvement for cabinets and shelves; and a chair or stool support. In accordance with other embodiment of the invention, the support system 20 can be utilized for Cripple Walls in foundation to reinforce and improve the strength and load bearing.

The assembly 22 can be adjusted for various sized planar surfaces. In accordance with some aspects and embodiments of the invention, the system 20 includes a non-telescopic support assembly, which is made of a fixed or single length piece with reinforcements on the end if needed, especially in instances where a shelf size is known and designed for this type of application. The assembly 22 includes end-peg 26. The end peg 26 can be reinforced. The assembly 22 can be secured or attached to the planar surface 24 to provide a stronger level of support. The end-peg 26 engages or is inserted into holes in a vertical support 28.

In accordance with one embodiment, the assembly 22 is telescopic and includes two pieces that slide across each other, for size adjustment. The assembly 22 spans the distance of the planar surface 24 and provide support across the length, instead of just at the ends. The end-peg 26 will have custom designed end points so that it can provide a means to fit into any sized holes of the vertical support.

In accordance with one embodiment, the assembly 22 is made of one piece and if of a fixed length.

In accordance with one embodiment, the assembly 22 includes spike-like end-pegs or tips, at each end, to help hold/lock the assembly 22 in place to the vertical support 28.

In accordance with one embodiment, the assembly 22 includes screw-like end-pegs, at each end, for a more permanent engagement with the vertical support 28.

Figure 3:
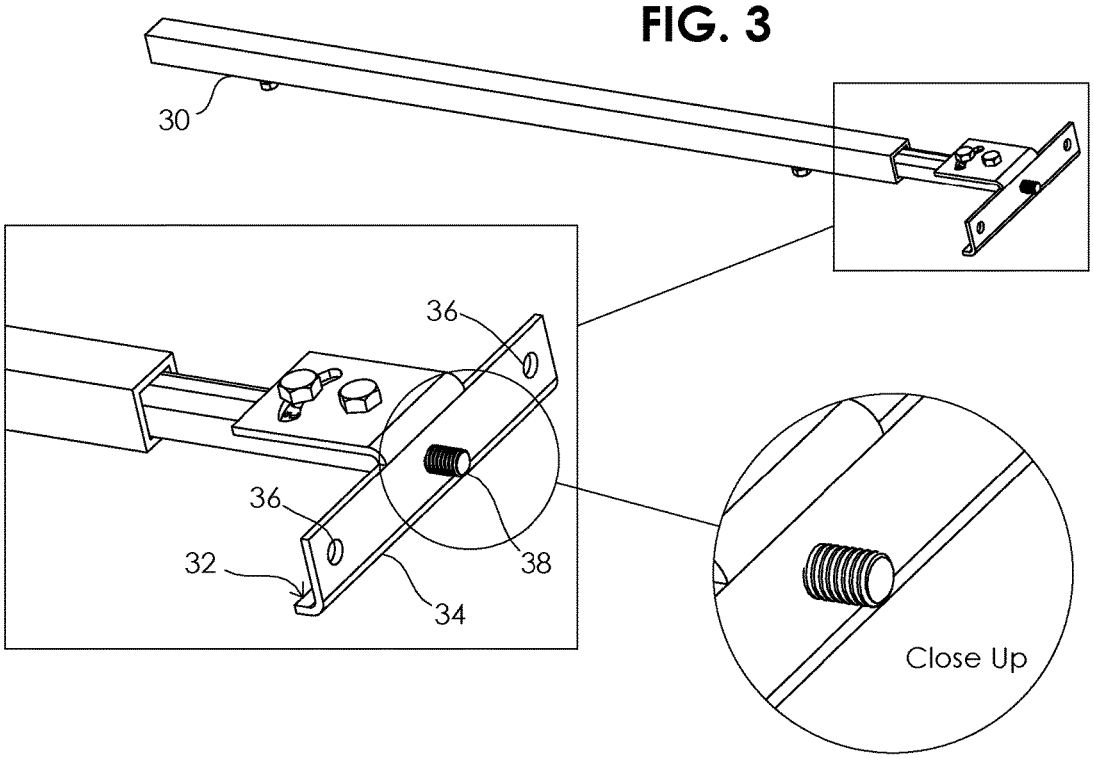
FIG. 3 shows a telescopic support assembly in accordance with various embodiments of the invention.

Referring now to FIG. 3, in accordance with one embodiment, an assembly 30 is shown with an end portion 32. The end portion 32 includes or is secured to a bracket 34 that defines screw holes 36 for extra support. The screw holes 36 can receive a screw for securing the assembly 30 to a vertical support in addition to the end-peg 38 engaging a hole in the vertical support. This option can help the assembly 30 provide support and fit nonstandard planar support systems or assemblies. This allows for set screws to be inserted into the bracket 34's screw holes for a superior hold. In accordance with various embodiments, the bracket 34 can either be fixed or be movable, like a hinge or a slot.

A hinge can be placed on at or near the end of the bracket 34 so that the assembly 30 does not have to be linear or so that a vertical support assembly, which does not have a linear hole pattern, can be supported as well. This allows the assembly 30 to go across from one side, front holes of a vertical support, to a second side, rear holes of the vertical support.

In use, the support assembly can help straighten out a bowed planar surface or shelf. If the assembly is applied after the planar surface had failed due to bowing, then the assembly, over time, bends back and flattens out the planar surface as a user puts weight at the appropriate locations on the planar surface.

Material that is used in construction can come with an unlimited number or finishes based on an unlimited combination of or individual materials.

Referring to FIGS. 12A-F, a bracket 120 is shown for the assembly or support system. In accordance with the various aspects of the invention, the bracket comes in a variety of styles, a potential for adding various end pieces, or even screw in pegs, which screw opposite direction, to make sure they do not loosen once installed into the shelf system. The bracket 12 includes a side support 122 that defines a center opening 122*a* and openings 122*b*. The center opening 122*a* is for aligning the bracket 120 with a hole in a vertical support. In accordance with one embodiment, the center opening 122*a* is define a smooth bore. In accordance with one embodiment, the center opening 122*a* defines a threaded bore. The scope of the invention is not limited by the bored that is defined by the center opening 122*a* and any type of bore can be defined thereby.

The bracket 120 also includes an upper support 124 defining opening 124*a*. The upper support 124 engages and supports a planar surface. The bracket 120 is secured to one end of a support assembly using holes 124*a*. Many different materials and style options that can be used for the bracket 120 and the scope the invention is not limited by the type of material used to manufacture the support assembly or the bracket 120.

Figure 4:
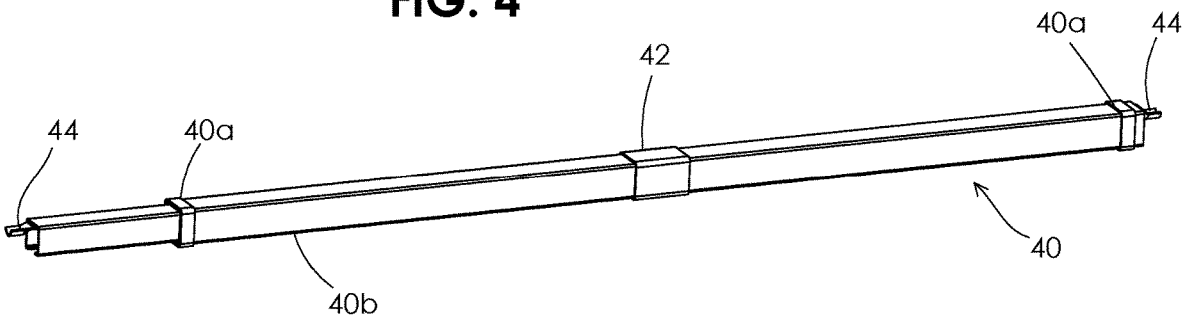
FIG. 4 shows an assembly that is adjustable in accordance with various embodiments of the invention.

Referring now to FIG. 4, shown is an assembly 40 in accordance with various embodiments of the invention. The assembly 40 includes two slide rail pieces that slide into each other to create the assembly 40. The assembly 40 includes bands 40*a*, which prevent the sliding rails from flexing outward and lock the sliding rails into place. A lip can be added if needed to bands 40*a*, which will allow the sliding pieces to be limited on how far the sliding pieces can move. The assembly 40 includes reinforced piece 42 designed to add strength and support the sliding pieces when extended outward. The assembly 40 includes end-pegs 44, which can be riveted, or spot welded, or even adhered, depending on material. There is also the option of having end-peg 44 as part of the assembly 40 in the form of a one-piece assembly 40*a*, so that it is formed with the sliding piece it is attached to in accordance with some embodiment of the invention.

Figure 5:
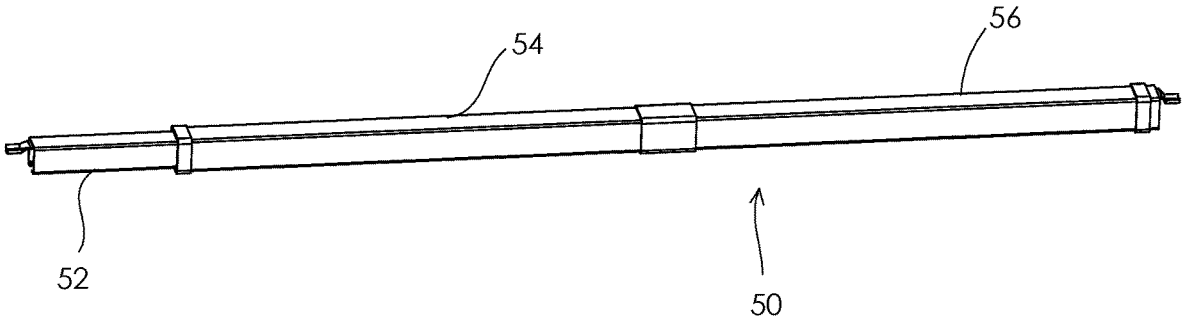
FIG. 5 shows an assembly having three pieces that are adjustable in accordance with the various embodiment of the invention.

Referring now to FIG. 5, FIG. 6 and FIG. 7, an assembly 50 is shown having two sliding portions 52 and 56 that slide into a center portion 54. The sliding portions 52 and 56 each include an end-peg for engaging a vertical support.

Referring now to FIGS. 8A-8G, the assembly 50 of FIG. 6 is shown in accordance with various embodiments of the invention. The assembly 50 includes sliding portions 52 and 56 that slide into a center portion 54.

Figure 9A:
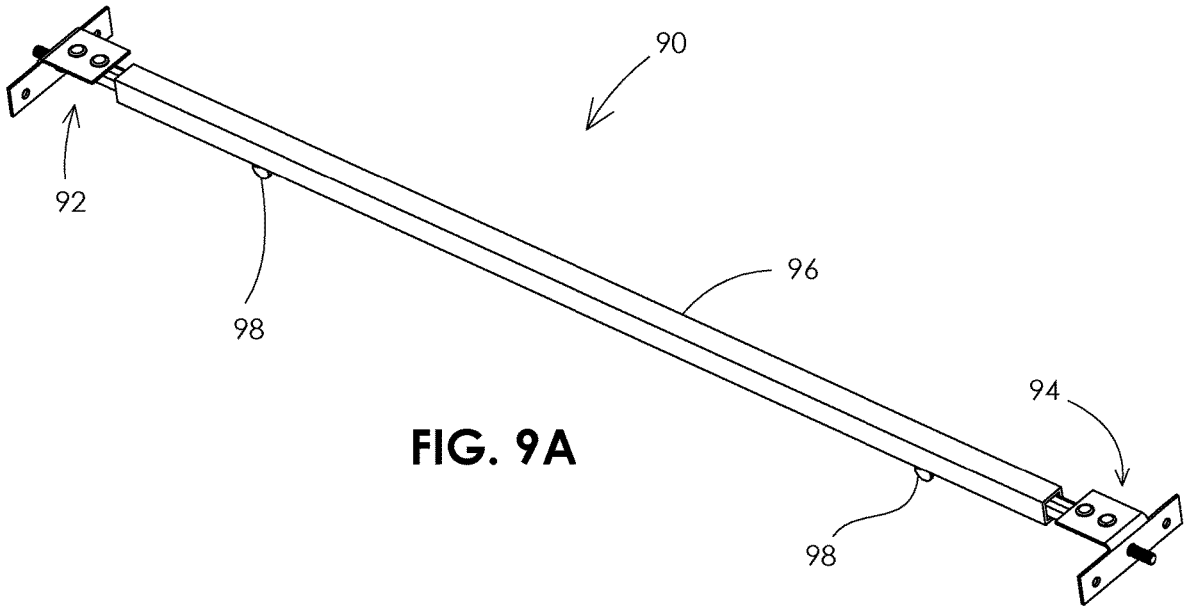
FIG. 9A shows a perspective view of a support assembly in accordance with various embodiments of the invention.

Referring now to FIG. 9A-9H, a support assembly 90 is shown in accordance with various embodiment of the invention. The assembly 90 includes two ends 92 and 94 and a center portion 96 that is a tube-like fixture. Ends 92 and 94 slide into the center portion 96. In accordance with one embodiment of the invention, the assembly 90 also includes set-screws 98 in two places, each engaging of one ends 92 and 94, to lock the ends 92 and 94 in place and prevent sliding. Also, set-screws 98 help prevent flexing. Also, set-screws 98, can be installed to allow the ends 92 and 94 to move or adjust and limit how far the ends 92 and 94 move because the ends 92 and 94, each, include a stop-tab 99 as shown in FIG. 9F.

Referring now to FIG. 10A-10H, in accordance with some embodiments of the invention, an end portion 100 is shown. The end portion 100 includes a sliding end 102 with a stop-tab 104. In accordance with other embodiments, the sliding end 102 includes a hole where the stop-tab 104 is located, either in place of or in addition to the stop-tab 104. The end portion 100 also includes a bracket end 106 secured to the sliding end 102. In accordance with one embodiment, the set-screw 98 acts as a locking mechanism and/or prevents the sliding end 102 (or end 92 and end 94 as they are functionally similar) from sliding out of center portion, such as center portion 96.

Figure 10A:
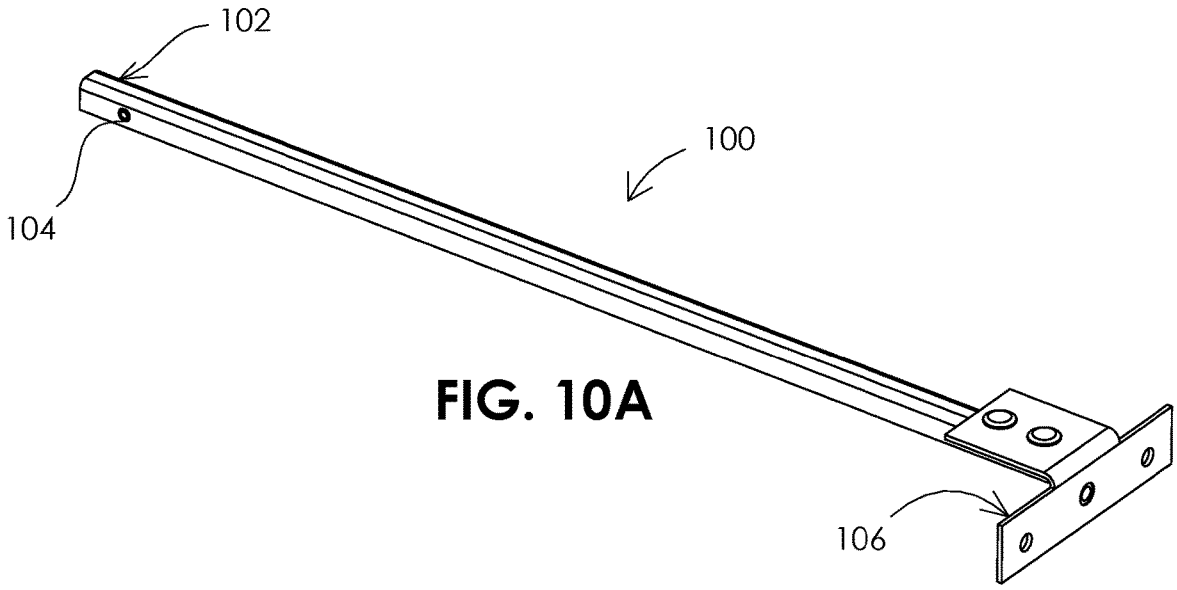
FIG. 10A shows a top perspective view of one end piece assembly that slides into a central support bar or center portion in accordance with various embodiments of the invention.
Figure 10:
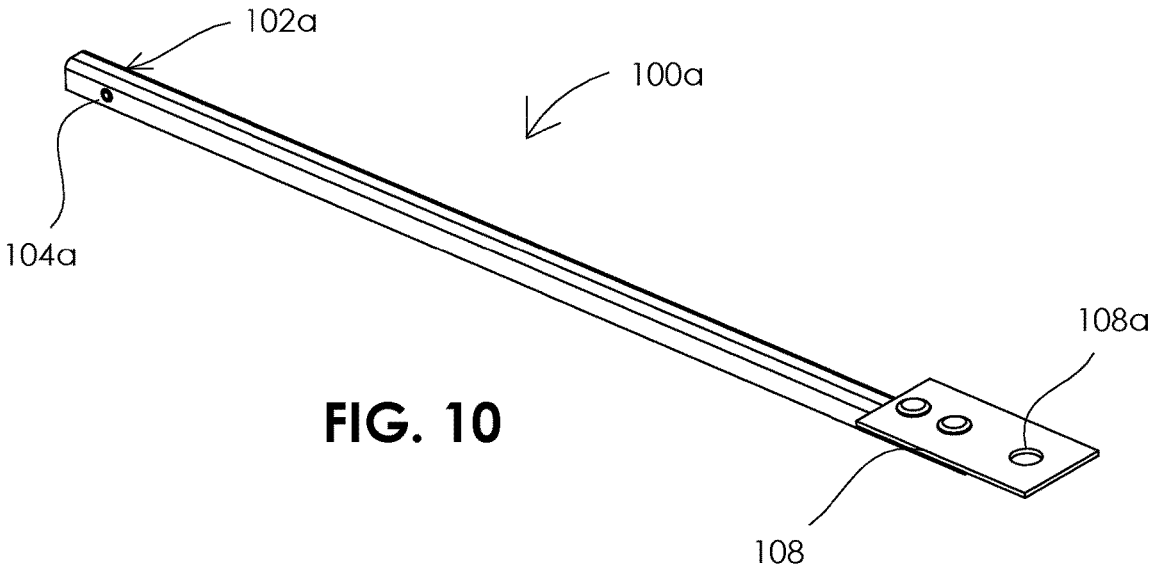
FIG. 10B shows a top view of the one end piece assembly of FIG. 10A in accordance with various embodiments of the invention.
FIG. 10C shows a cross-section view taken along line A-A of FIG. 10B in accordance with various embodiments of the invention.
FIG. 10D shows a side view of the one end piece assembly of FIG. 10B in accordance with various embodiments of the invention.
FIG. 10E shows one end view of the one end piece assembly of FIG. 10D in accordance with various embodiments of the invention.
FIG. 10F shows one end view of the one end piece assembly of FIG. 10D in accordance with various embodiments of the invention.
FIG. 10G shows a bottom view of the one end piece assembly of FIG. 10A in accordance with various embodiments of the invention.
FIG. 10H shows a bottom perspective view of the one end piece assembly of FIG. 10G in accordance with various embodiments of the invention.
FIG. 10I shows a perspective view of one end piece assembly that slides into a central support bar in accordance with various embodiments of the invention.
Figure 10B:
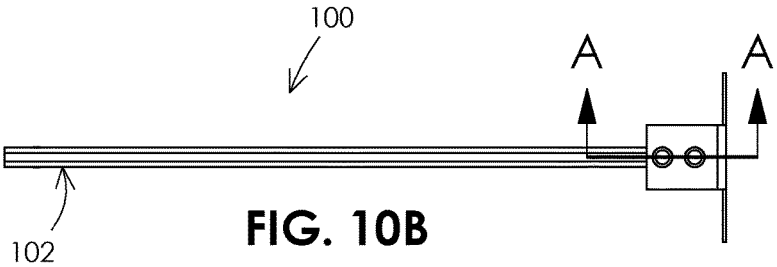

Referring now to FIG. 10A and FIG. 10I, by way of example and in accordance with some embodiment of the invention, the end portion 100 (or end portion 100*a*) is used to provide cross or diagonal support for a planar surface. The bracket end 106 (or 108) is coupled to the sliding end 102 (or 102*a*) using a hinge or a slot. The sliding end 102 (or 102*a*) can be angled relative to the bracket end 106 (or 108) and adjusted for proper fit when the assembly is positioned diagonally across the planar surface from one corner to a diagonally-opposite corner. The sliding end 102 (or 102*a*) will have a certain degree of planar movement relative to the bracket end 106 (or 108), so that the axis of the sliding end 102 (or 102*a*) is able to move in a plane relative to the vertical support and pivot at the bracket end 106 (or 108).

Figure 10C:
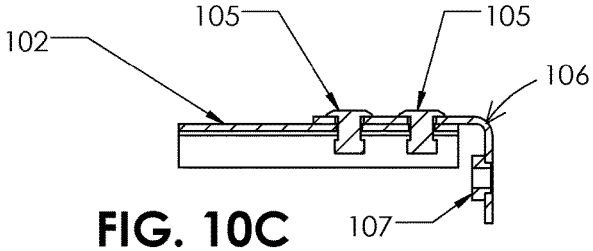
Figure 10H:
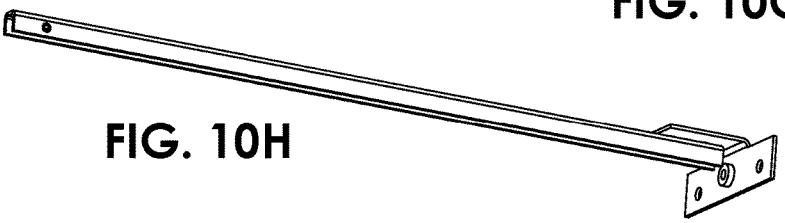
Figure 10E:
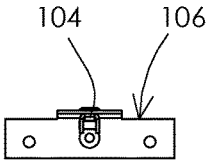
Figure 10D:
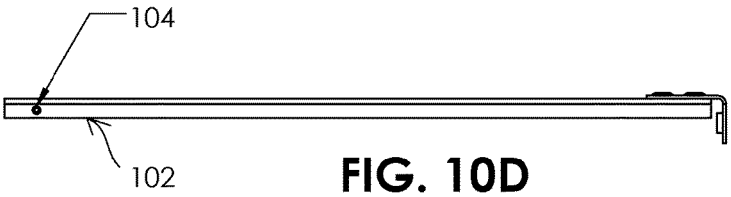
Figure 10F:
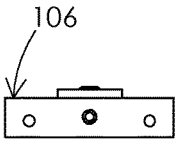
Figure 10G:
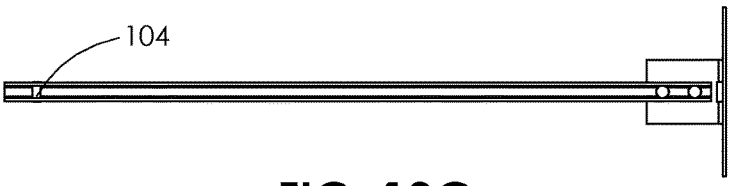
Figure 11B:
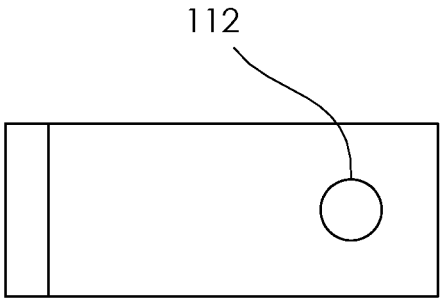
FIG. 11B shows a top view of the apparatus of FIG. 11A in accordance with various embodiments of the invention.
Figure 11A:
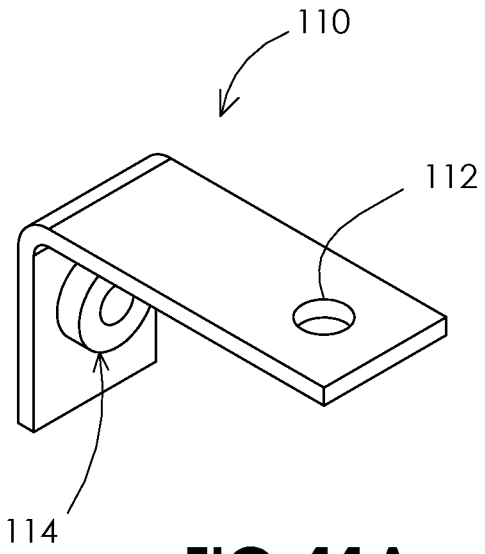
FIG. 11A shows a perspective view of an apparatus that can be used to support planar surfaces or shelves in accordance with various embodiments of the invention.
Figure 11C:
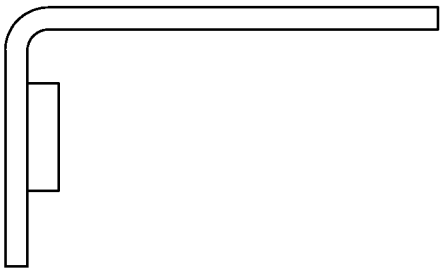
FIG. 11C shows a side view of the apparatus of FIG. 11A in accordance with various embodiments of the invention.
Figure 11D:
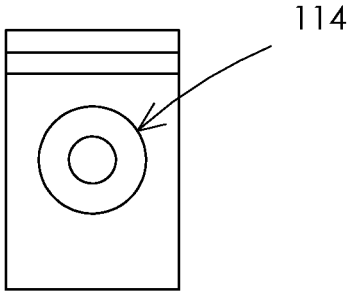
FIG. 11D shows a front view of the apparatus of FIG. 11A in accordance with various embodiments of the invention.
Figure 12E:
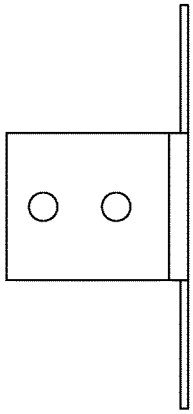
FIG. 12E shows a top view of the apparatus of FIG. 12A in accordance with various embodiments of the invention.
Figure 12C:
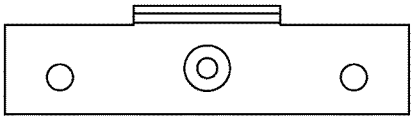
FIG. 12C shows a front view of the apparatus of FIG. 12A in accordance with various embodiments of the invention.
Figure 12B:
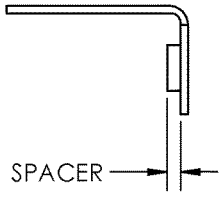
FIG. 12B shows a side view of the apparatus of FIG. 12A in accordance with various embodiments of the invention.
Figure 12D:
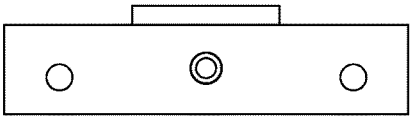
FIG. 12D shows a back view of the apparatus of FIG. 12A in accordance with various embodiments of the invention.
Figure 12A:
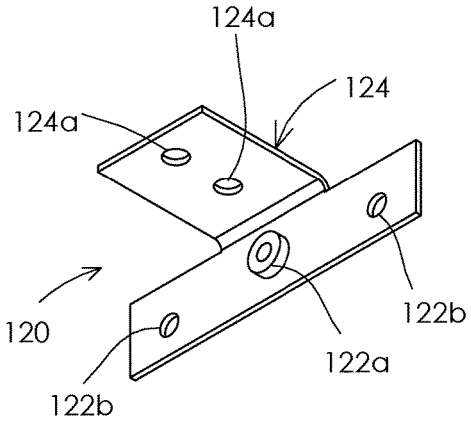
FIG. 12A shows a bottom perspective view of an apparatus used in the assembly of FIG. 10A-FIG. 10H in accordance with various embodiments of the invention.
Figure 12F:
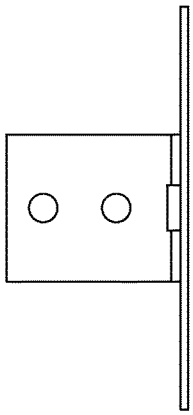
FIG. 12F shows a bottom view of the apparatus of FIG. 12A in accordance with various embodiments of the invention.

Referring now to FIG. 10C, the bracket end 106 is shown secured to the end 102 through rivets 105. The bracket end 106, in according to some embodiments of the invention, defines a bore 107.

Referring now to FIG. 10I, an end portion 100*a* is shown in accordance with some embodiment of the invention. The end portion 100*a* includes a sliding end 102*a* with a stop-tab 104*a*, similar to the end portion 100 of FIG. 10A. In accordance with other embodiments, the sliding end 102*a* includes a hole where the stop-tab 104*a* is located, either in place of or in addition to the stop-tab 104*a*. The end portion 100*a* also includes a bracket end 108 secured to the sliding end 102*a*. The bracket end 108 defines an opening 108*a*. In this way, the end portion 100*a*, which is used in combination with a second and similar end portion, can be positioned across a planar surface. The end portion 100*a* is secured to an angle bracket, which is coupled to a vertical portion, using the opening 108*a*. In accordance with one embodiment, the end portion 108*a* runs the length of a planar surface from one corner of the planar surface to an opposite corner. In accordance with one embodiment, the end portion 100*a* runs diagonally across the length of a planar surface from one corner of the planar surface to a diagonally opposite corner.

In accordance with various embodiments of the invention, a spring (not shown) can be inserted or added inside the ends 92 and 94 to provide positive force that forces the assembly 90 against the vertical support to prevent the assembly 90 form disengaging the vertical support and preventing the ends 92 and 94 from sliding away from their respective vertical support.

In accordance with various embodiments of the invention the ends 92 and 94 can be manufactured with designed-in-friction coupling between the end 92 (or end 94) and the center portion 96, such the friction keeps the ends 92 and 94 in position relative to the center portion 96.

Any combination of set-screws, spring, and designed-in-friction can be utilized in various embodiments of the assembly 90.

Referring now to FIG. 11A-11D, in accordance with some embodiment of the invention, an apparatus 110 is shown. The apparatus 110 can be used with the bracket end 106 of the end portion 100, in one embodiment. In another embodiment, the apparatus 110 can replace the bracket end 106. In yet another embodiment, the apparatus 110 can be used with pegs, such as shown in FIG. 1. The apparatus 110 defines a hole 112 for receiving a means for securing the apparatus 110 to a planar surface. The apparatus 110 also includes a bore 114 with a spacer for receiving a means to couple or connect or attach or hold or securing the apparatus 110 to a vertical support.

In accordance with various embodiment of the invention, the telescopic support assembly can made of any material. The assembly is made of any combination of materials or a single type of material as needed. For example, the end portions may be made of metal or plastic. The center portion may be made of metal or plastic. The bracket or end-pegs may be made of metal or plastic.

Unless defined otherwise, all technical and scientific terms used herein have the same meaning as commonly understood by one of ordinary skill in the art to which this invention belongs. The verb couple, its gerundial forms, and other variants, should be understood to refer to either direct connections or operative manners of interaction between elements of the invention through one or more intermediating elements, whether or not any such intermediating element is recited. Any methods and materials similar or equivalent to those described herein can also be used in the practice of the invention. Representative illustrative methods and materials are also described.

All publications and patents cited in this specification are herein incorporated by reference as if each individual publication or patent were specifically and individually indicated to be incorporated by reference and are incorporated herein by reference to disclose and describe the methods and/or system in connection with which the publications are cited. The citation of any publication is for its disclosure prior to the filing date and should not be construed as an admission that the invention is not entitled to antedate such publication by virtue of prior invention. Further, the dates of publication provided may be different from the actual publication dates which may need to be independently confirmed.

Additionally, it is intended that such equivalents include both currently known equivalents and equivalents developed in the future, i.e., any elements developed that perform the same function, regardless of structure. The scope of the invention, therefore, is not intended to be limited to the exemplary embodiments shown and described herein.

Accordingly, the preceding merely illustrates the various aspects and principles as incorporated in various embodiments of the invention. It will be appreciated that those of ordinary skill in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

Where a range of values is provided, it is understood that each intervening value, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention. Certain ranges are presented herein with numerical values being preceded by the term "about." The term "about" is used herein to provide literal support for the exact number that it precedes, as well as a number that is near to or approximately the number that the term precedes. In determining whether a number is near to or approximately a specifically recited number, the near or approximating unrecited number may be a number which, in the context in which it is presented, provides the substantial equivalent of the specifically recited number.

Therefore, the scope of the invention, therefore, is not intended to be limited to the various aspects and embodiments discussed and described herein. Rather, the scope and spirit of invention is embodied by the appended claims.

The invention claimed is:

1. An adjustable support assembly for securing to two vertical supports, one at each end, and for supporting a planar surface, the adjustable support assembly comprising:

a first u-channel section having a first end and a second end and including:

a first L-shaped bracket secured to the first end of the first u-channel section for securing the adjustable support assembly to one of the two vertical supports; and a pin-hole defined by the first u-channel section at the second end of the first u-channel section;

a second u-channel section having a first end and a second end and including:

a second L-shaped bracket secured to the second end of the second u-channel section for securing the adjustable support assembly to another one of the two vertical supports; and a pin-hole defined by the second u-channel section at the first end of the second u-channel section: and a center square tubular section, wherein the second end of the first u-channel section is inserted in to one end of the center square tubular section and the first end of the second u-channel section is inserted into an opposite end of the center square tubular section thereby allowing the adjustable support assembly to be adjusted to the planar surface's length and for securing the adjustable support assembly to the two vertical supports using the first L-shaped bracket of the first u-channel section and the second L-shaped bracket of the second u-channel section.

2. The assembly of claim 1, wherein the first L-shaped bracket includes a vertical surface for contacting one of the two vertical supports and further defines three holes and comprises a spacer, wherein the three holes are equally spaced horizontally and offset vertically such that the three holes define a triangular shape.

3. The assembly of claim 1, wherein the first L-shaped bracket defines a bore for engaging a hole defined in one of the two vertical supports and the second L-shaped bracket includes an end-peg for engaging a hole defined in another one of the two vertical supports.

4. The assembly of claim 1, wherein the first u-channel section includes a set-screw for locking the position of the first L-shaped bracket's position relative to the center square tubular section.

5. The assembly of claim 4, wherein the second u-channel section includes a set-screw for locking the second L-shaped bracket's position relative to the center square tubular section.

6. The assembly of claim 1, wherein the first L-shaped bracket and the second L-shaped bracket are adjustable relative to the first u-channel section and the second u-channel section, respectively, such that the adjustable support assembly is capable of supporting the planar surface at diagonally opposite corners.

* * * * *